US009360796B2

(12) United States Patent
Leemhuis

(10) Patent No.: US 9,360,796 B2
(45) Date of Patent: Jun. 7, 2016

(54) ANGLED TONER PADDLES FOR A REPLACEABLE UNIT OF AN IMAGE FORMING DEVICE

(71) Applicant: Lexmark International, Inc., Lexington, KY (US)

(72) Inventor: Michael Craig Leemhuis, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/306,416

(22) Filed: Jun. 17, 2014

(65) Prior Publication Data

US 2015/0355575 A1 Dec. 10, 2015

Related U.S. Application Data

(60) Provisional application No. 62/007,982, filed on Jun. 5, 2014.

(51) Int. Cl.
*G03G 15/08* (2006.01)

(52) U.S. Cl.
CPC ..... *G03G 15/0865* (2013.01); *G03G 15/087* (2013.01); *G03G 15/0867* (2013.01); *G03G 15/0891* (2013.01); *G03G 2215/0833* (2013.01)

(58) Field of Classification Search
CPC ..... G03G 15/0839; G03G 15/0834; G03G 15/0836; G03G 15/0837; G03G 15/0889; G03G 15/0891; G02G 2215/0802; G02G 2215/0819; G02G 2215/0827; G02G 2215/083
See application file for complete search history.

(56) References Cited

U.S. PATENT DOCUMENTS 5,206,692 A * 4/1993 Ishida ..... G03G 21/12 399/258
5,655,195 A 8/1997 Ichikawa et al.
5,835,827 A * 11/1998 Kishimoto ..... B01F 7/32 366/313
5,875,378 A 2/1999 Campbell et al.
6,100,601 A 8/2000 Baker et al.
6,385,422 B1 5/2002 Ishiguro et al.

(Continued)

FOREIGN PATENT DOCUMENTS

JP 2002-229320 A 8/2002

OTHER PUBLICATIONS

International Search Report and Written Opinion of the International Searching Authority dated Aug. 31, 2015 for PCT Application No. PCT/US15/32781.

*Primary Examiner* — Clayton E Laballe
*Assistant Examiner* — Victor Verbitsky
(74) *Attorney, Agent, or Firm* — Justin M Tromp

(57) ABSTRACT

A replaceable unit for an electrophotographic image forming device according to one embodiment includes a housing having a reservoir for storing toner and an outlet for exiting toner from the housing. A channel in fluid communication with the outlet has an inlet positioned between the first end and the second end of the reservoir. A rotatable auger is positioned along the channel. Paddles extend from a rotatable shaft in the reservoir. A first set of one or more paddles are positioned between a first end of the reservoir and the inlet of the channel and a second set of one or more paddles are positioned between a second end of the reservoir and the inlet of the channel. The first and second sets of paddles are angled to direct toner away from the first end and the second end of the reservoir, respectively, and toward the inlet of the channel.

16 Claims, 9 Drawing Sheets

(56) References Cited

U.S. PATENT DOCUMENTS

| | | | | |
|---|---|---|---|---|
| 6,418,290 | B1 * | 7/2002 | Isomura | G03G 15/0875 399/254 |
| 6,456,810 | B1 | 9/2002 | Deguchi et al. | |
| 6,459,876 | B1 | 10/2002 | Buchanan et al. | |
| 6,470,163 | B1 * | 10/2002 | Minagawa | G03G 15/0875 29/889.1 |
| 6,496,662 | B1 | 12/2002 | Buchanan et al. | |
| 7,433,632 | B2 | 10/2008 | Askren et al. | |
| 7,532,843 | B2 | 5/2009 | Kern et al. | |
| 8,059,993 | B2 | 11/2011 | Gayne et al. | |
| 8,095,062 | B2 | 1/2012 | Maddux et al. | |
| 8,660,469 | B2 | 2/2014 | Carter et al. | |
| 8,688,016 | B2 | 4/2014 | Carter et al. | |
| 8,718,496 | B2 | 5/2014 | Barry et al. | |
| 2002/0025192 | A1 * | 2/2002 | Matsuda | G03G 15/0898 399/258 |
| 2006/0222414 | A1 | 10/2006 | Yamamura | |
| 2007/0269238 | A1 | 11/2007 | Sato | |
| 2007/0280739 | A1 | 12/2007 | Tanaka | |
| 2008/0095553 | A1 | 4/2008 | Tanaka et al. | |
| 2008/0124119 | A1 * | 5/2008 | Oda | G03G 15/0898 399/120 |
| 2008/0226351 | A1 | 9/2008 | Dawson et al. | |
| 2009/0060588 | A1 | 3/2009 | Tanaka | |
| 2009/0087222 | A1 | 4/2009 | Mase et al. | |
| 2009/0087226 | A1 * | 4/2009 | Yamazaki | G03G 15/0877 399/263 |
| 2009/0274491 | A1 | 11/2009 | Sato | |
| 2011/0008076 | A1 | 1/2011 | Kuroyama | |
| 2013/0170875 | A1 | 7/2013 | Sproul et al. | |
| 2013/0279941 | A1 | 10/2013 | Poterjoy et al. | |
| 2014/0199097 | A1 | 7/2014 | Carter et al. | |

* cited by examiner

ANGLED TONER PADDLES FOR A REPLACEABLE UNIT OF AN IMAGE FORMING DEVICE

CROSS REFERENCES TO RELATED APPLICATIONS

This patent application claims priority to U.S. Provisional Patent Application Ser. No. 62/007,982, filed Jun. 5, 2014, entitled "Angled Toner Paddles for a Replaceable Unit of an Image Forming Device," the content of which is hereby incorporated by reference in its entirety.

BACKGROUND

1. Field of the Invention

The present invention relates generally to electrophotographic image forming devices and more particularly to angled toner paddles for a replaceable unit of an image forming device.

2. Description of the Related Art

In electrophotographic image forming devices, one or more replaceable toner cartridges may be used to supply toner to the device for printing onto sheets of media. When a toner cartridge is installed in an image forming device, the toner cartridge supplies toner stored in a reservoir within the toner cartridge through an outlet port on the toner cartridge to a corresponding inlet port in the device. Toner cartridges often include toner agitators, paddles or augers within the reservoir that fluff and mix the toner to prevent it from clumping and that move the toner to the outlet port.

For example, a first prior art toner cartridge 10 is shown in FIG. 1A with an end wall removed to more clearly illustrate the internal components of toner cartridge 10. Toner cartridge 10 is cylindrically shaped and includes a rotatable metal helix 12 within a toner reservoir 14 of the cartridge 10. As metal helix 12 rotates, it contacts an interior surface 16 of toner cartridge 10 and moves toner in reservoir 14 toward an outlet port near an end wall 18 of toner cartridge 10. However, metal helix 12 is rigid and does not conform to the shape of interior surface 16. As a result, metal helix 12 leaves a large amount of residual toner in reservoir 14 and is noisy when it rotates.

FIG. 1B shows a second prior art toner cartridge 20 with an outer wall removed to more clearly illustrate the internal components of toner cartridge 20. Toner cartridge 20 includes a molded plastic paddle 22 within a toner reservoir 24 of the cartridge 20. Paddle 22 includes a series of plastic, curved arms 26 that extend away from a central shaft 28 and together form a segmented helix. Curved arms 26 contact an interior surface 30 of toner cartridge 20. As shaft 28 rotates, curved arms 26 move toner in reservoir 24 toward an outlet port 32 near an end wall 34 of toner cartridge 20. Curved arms 26 are rigid and do not conform to the shape of interior surface 30. As a result, paddle 22 tends to leave a large amount of residual toner in reservoir 24.

FIG. 1C shows a third prior art toner cartridge 40 with a top wall removed to more clearly illustrate the internal components of toner cartridge 40. Toner cartridge 40 includes a toner reservoir 42 having an auger 44 mounted in a trough 46 along the entire length of reservoir 42. A flexible toner paddle 48 in the form of a flexible plastic sheet is mounted on a rotatable shaft 50 that extends along the entire length of reservoir 42, substantially parallel to auger 44. Toner paddle 48 and shaft 50 are positioned in a portion of reservoir 42 next to trough 46 and separated from trough 46 by a wall 52 that extends part way up from the bottom of reservoir 42. As shaft 50 rotates, flexible toner paddle 48 wipes toner from an interior surface 54 of reservoir 42 and advances along the bottom of reservoir 42 toward wall 52. When the distal end of toner paddle 48 reaches the top of wall 52, toner paddle 48 flips toner into trough 46 as the distal end of toner paddle 48 disengages from wall 52 in an elastic manner. However, the flipping action of toner paddle 48 tends to generate noise. Residual toner also tends to accumulate below auger 44.

Further, the flow rates of toner from many toner cartridges often vary greatly depending on the amount of toner left in the toner reservoir. As a result, such toner cartridges often require metering systems in the image forming device downstream from the toner cartridge to control the flow rate of toner. These downstream metering systems impose additional manufacturing cost. Accordingly, an improved, cost-effective system for agitating and moving toner inside a toner cartridge is desired that reduces noise and residual toner amounts.

SUMMARY

A replaceable unit for an electrophotographic image forming device according to one example embodiment includes a housing having a toner reservoir. The housing has an outlet for exiting toner. The housing has a channel along at least a portion of its length. The channel forms an inlet between a first and an opposed second end of the reservoir. The inlet is in fluid communication with the reservoir to receive toner. The channel is in fluid communication with the outlet for exiting toner from the channel. A rotatable auger is positioned along the channel for moving toner therein toward the outlet. A rotatable shaft has a first end at the first end of the reservoir and a second end at the second end of the reservoir. A plurality of paddles extend from the shaft and are rotatable therewith. The plurality of paddles has a first set of one or more paddles between the first end of the reservoir and the inlet and a second set of one or more paddles between the second end of the reservoir and the inlet. The first set is angled to direct toner away from the first end of the reservoir and toward the inlet. The second set is angled to direct toner away from the second end of the reservoir and toward the inlet.

A replaceable unit for an electrophotographic image forming device according to another example embodiment includes a housing having a reservoir for toner. The housing has an outlet for exiting toner and a channel along at least a portion of a length of the housing. The channel has an inlet positioned between a first end and an opposed second end of the reservoir. The inlet is in fluid communication with the reservoir for receiving toner therefrom. The channel is in fluid communication with the outlet for exiting toner from the channel. A rotatable auger is positioned along the channel for moving toner therein toward the outlet. A rotatable shaft has a first end at the first end of the reservoir and a second end at the second end of the reservoir. A first portion of the shaft is between the first end of the reservoir and the inlet. A second portion of the shaft is between the second end of the reservoir and the inlet. A plurality of paddles are rotatable with the shaft. Each paddle is connected to the shaft by a corresponding pair of arms extending radially from the shaft. Adjacent paddles of the plurality of paddles alternate radially along the length of the shaft. The plurality of paddles includes a first set of one or more paddles on the first portion of the shaft and a second set of one or more paddles on the second portion of the shaft. The first set is angled to direct toner away from the first end of the reservoir and toward the inlet. The second set is angled to direct toner away from the second end of the reservoir and toward the inlet. A flexible member is mounted on a distal end of each of the plurality of paddles. At least a portion of each flexible member has an interference contact with at least a portion of an interior surface of the housing.

A replaceable unit for an electrophotographic image forming device according to another example embodiment includes a housing having a reservoir for storing toner. The housing has an outlet for exiting toner from the housing. A rotatable shaft has a first end at a first end of the reservoir and a second end at an opposed second end of the reservoir. A plurality of paddles extend from the shaft along a length of the shaft and are rotatable with the shaft. Each of the plurality of paddles includes a rigid and substantially straight segment that extends along the length of the shaft. A flexible member is mounted on a distal end of the substantially straight segment that extends radially outward past the distal end of the substantially straight segment. At least a portion of each flexible member has an interference contact with at least a portion of an interior surface of the housing. Each of the plurality of substantially straight segments is angled relative to the shaft to direct toner away from the first end of the reservoir and toward the second end of the reservoir.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1A:
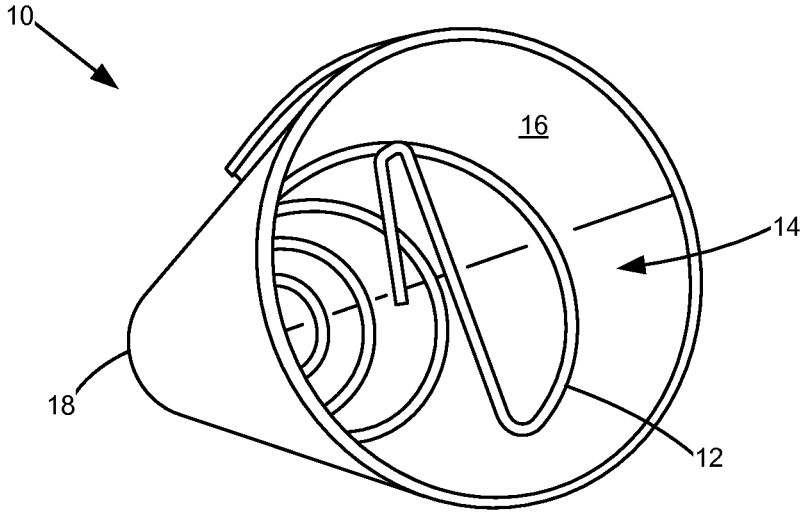
FIGURE 1A (Prior Art)
FIGS. 1A-1C are cutaway perspective views of three prior art toner cartridges.
Figure 1B:
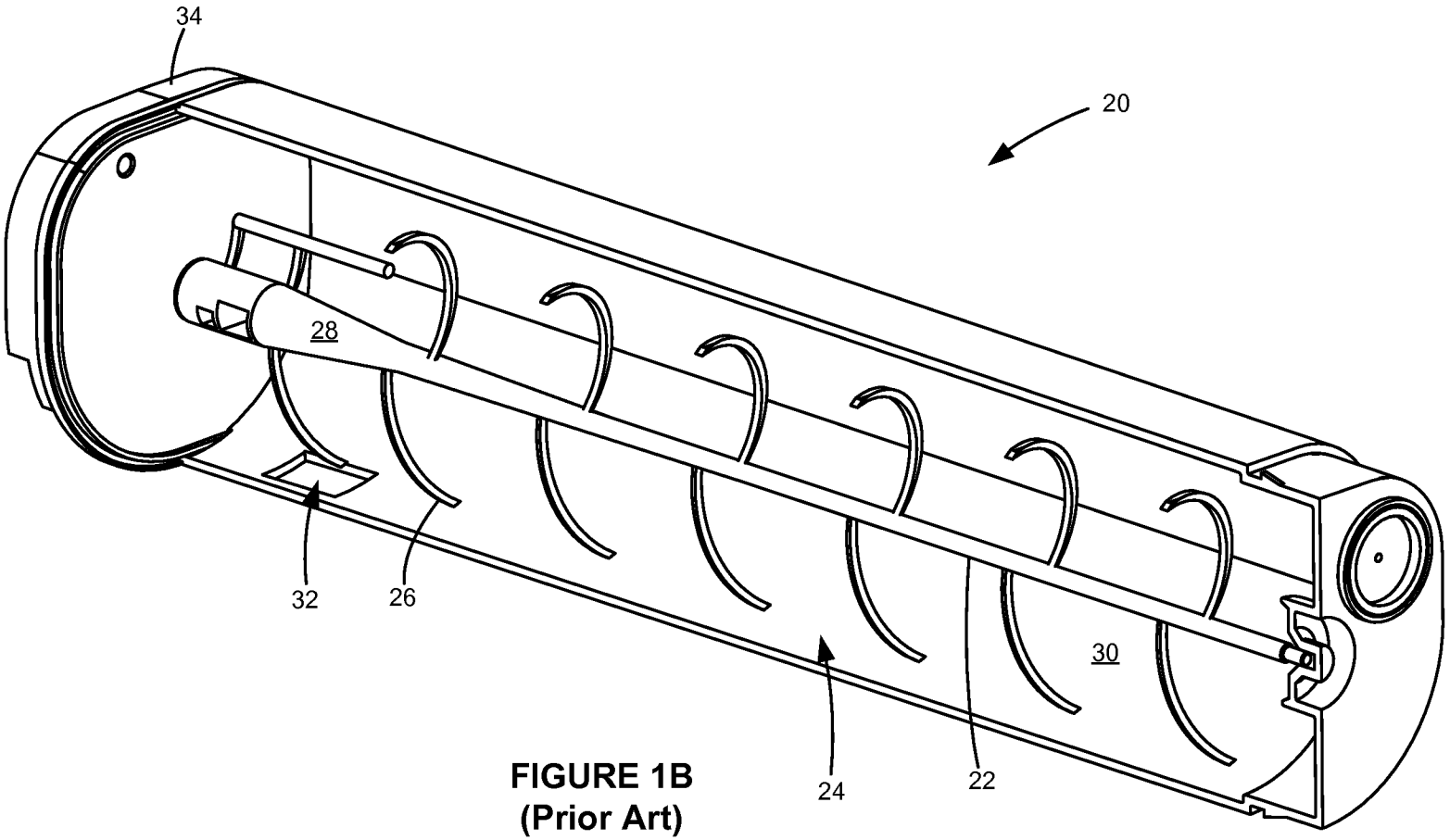
FIGURE 1B (Prior Art)
Figure 1C:
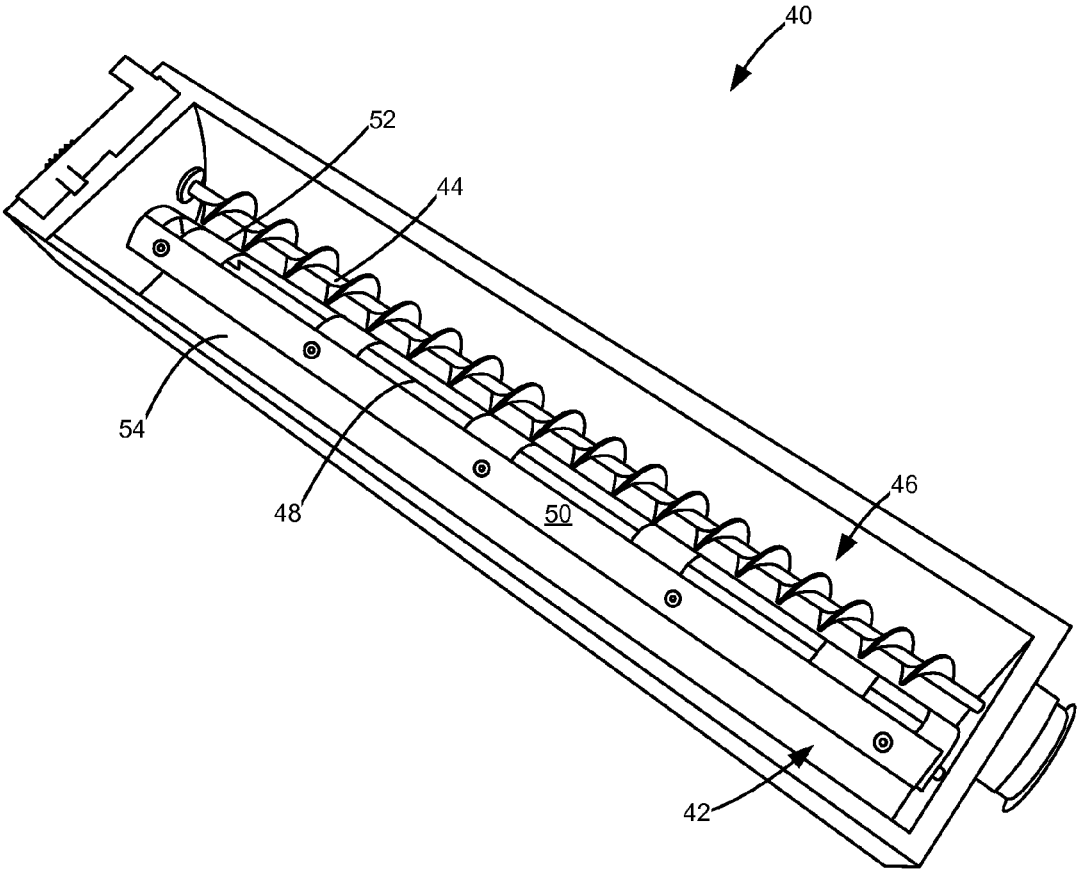
FIGURE 1C (Prior Art)
Figure 2:
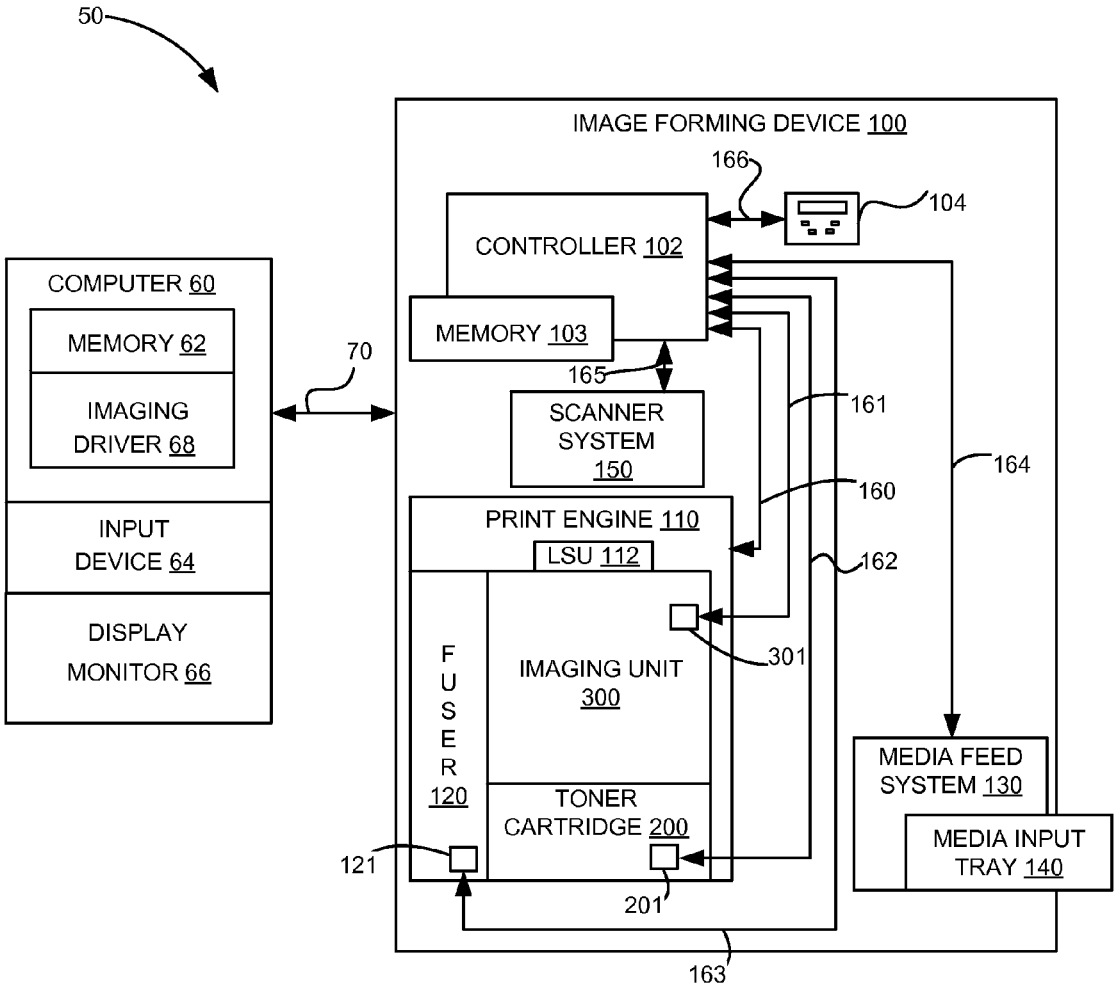
FIG. 2 is a block diagram of an imaging system including an image forming device according to one example embodiment.

Referring to the drawings and particularly to FIG. 2, there is shown a block diagram depiction of an imaging system 50 according to one example embodiment. Imaging system 50 includes an image forming device 100 and a computer 60. Image forming device 100 communicates with computer 60 via a communications link 70. As used herein, the term "communications link" generally refers to any structure that facilitates electronic communication between multiple components and may operate using wired or wireless technology and may include communications over the Internet.

In the example embodiment shown in FIG. 2, image forming device 100 is a multifunction device (sometimes referred to as an all-in-one (AIO) device) that includes a controller 102, a user interface 104, a print engine 110, a laser scan unit (LSU) 112, one or more toner bottles or cartridges 200, one or more imaging units 300, a fuser 120, a media feed system 130 and media input tray 140, and a scanner system 150. Image forming device 100 may communicate with computer 60 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 60, which is optional, may be, for example, a personal computer, including memory 62, such as RAM, ROM, and/or NVRAM, an input device 64, such as a keyboard and/or a mouse, and a display monitor 66. Computer 60 also includes a processor, input/output (I/O) interfaces, and may include at least one mass data storage device, such as a hard drive, a CD-ROM and/or a DVD unit (not shown). Computer 60 may also be a device capable of communicating with image forming device 100 other than a personal computer such as, for example, a tablet computer, a smartphone, or other electronic device.

In the example embodiment illustrated, computer 60 includes in its memory a software program including program instructions that function as an imaging driver 68, e.g., printer/scanner driver software, for image forming device 100. Imaging driver 68 is in communication with controller 102 of image forming device 100 via communications link 70. Imaging driver 68 facilitates communication between image forming device 100 and computer 60. One aspect of imaging driver 68 may be, for example, to provide formatted print data to image forming device 100, and more particularly to print engine 110, to print an image. Another aspect of imaging driver 68 may be, for example, to facilitate the collection of scanned data from scanner system 150.

In some circumstances, it may be desirable to operate image forming device 100 in a standalone mode. In the standalone mode, image forming device 100 is capable of functioning without computer 60. Accordingly, all or a portion of imaging driver 68, or a similar driver, may be located in controller 102 of image forming device 100 so as to accommodate printing and/or scanning functionality when operating in the standalone mode.

Figure 3:
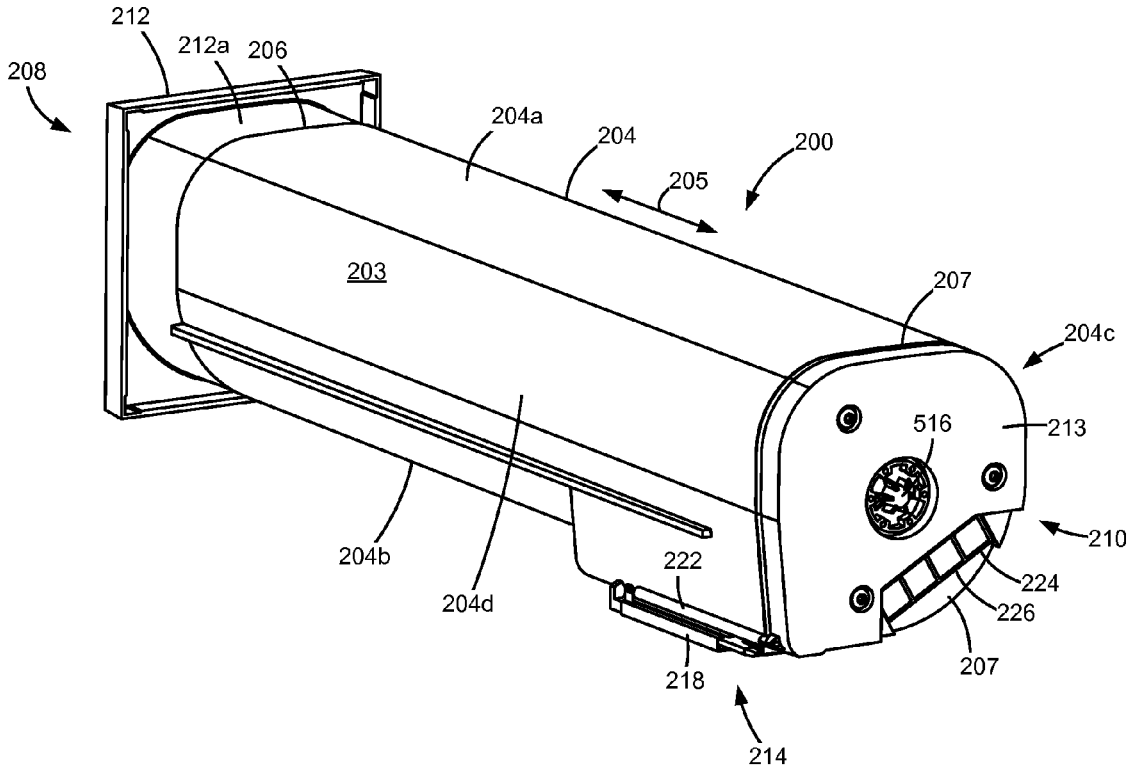
FIG. 3 is a perspective view of a toner cartridge of the image forming device according to one example embodiment.
Figure 4:
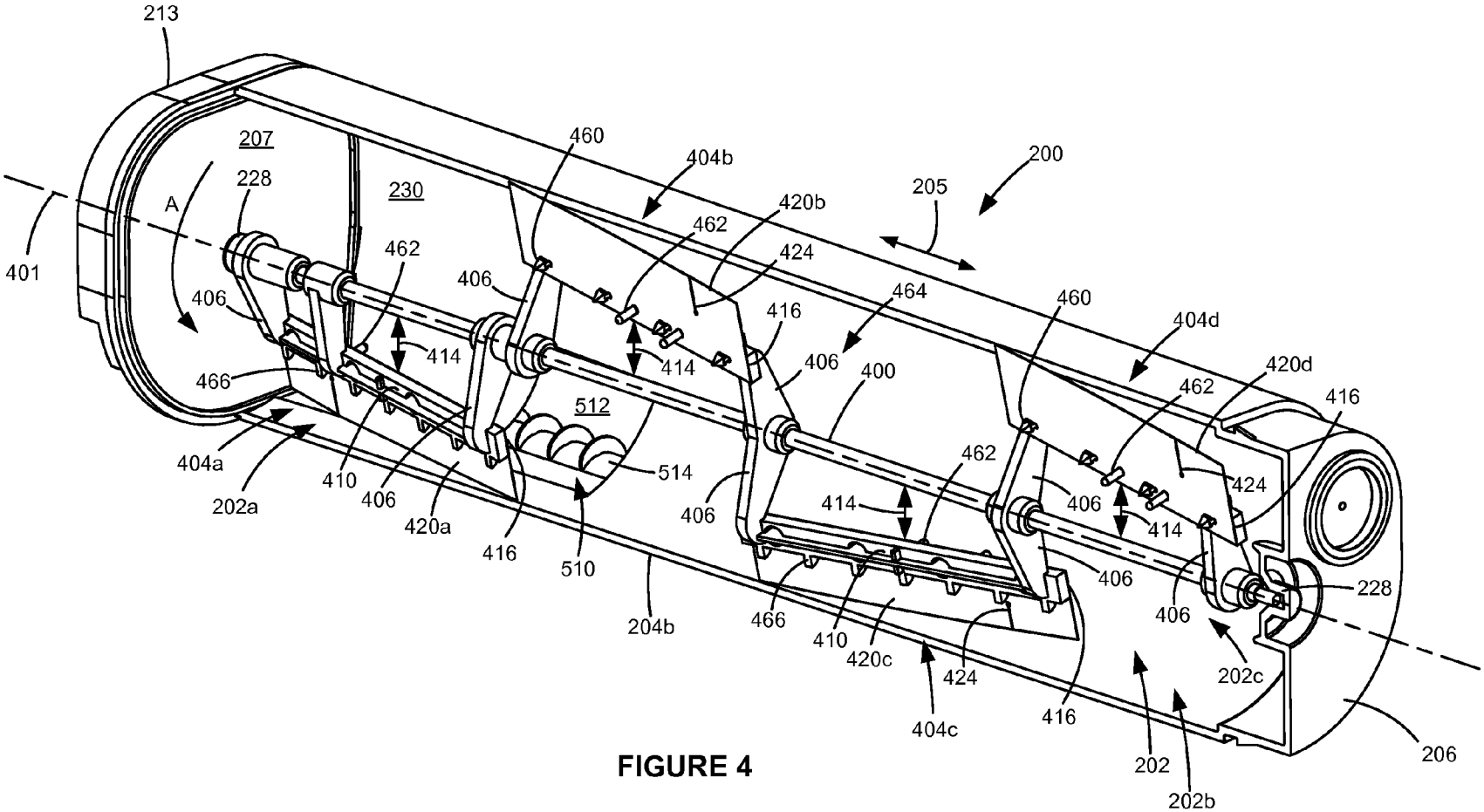
FIG. 4 is a perspective view of the toner cartridge of FIG. 3 with a portion of an outer wall removed according to one example embodiment.

FIG. 3 shows toner cartridge 200 according to one example embodiment. Toner cartridge 200 includes an elongated housing 203 that includes walls forming a toner reservoir 202 (FIG. 4). In the example embodiment illustrated, housing 203 includes a generally cylindrical wall 204 that extends along a lengthwise dimension 205 and a pair of end walls 206, 207 defining a front end 208 and a rear end 210, respectively, of toner cartridge 200. Wall 204 includes a top 204*a*, bottom 204*b* and sides 204*c*, 204*d*. In the embodiment illustrated, end caps 212, 213 are mounted on end walls 206, 207, respectively, such as by suitable fasteners (e.g., screws, rivets, etc.) or by a snap-fit engagement. An outlet port 214 is positioned on bottom 204*b* of housing 203 near end wall 207. Toner is periodically delivered from reservoir 202 through outlet port 214 to an inlet port of imaging unit 300 to refill a reservoir of imaging unit 300 as toner is consumed by the printing process.

As desired, outlet port 214 may include a shutter or cover that is movable between a closed position blocking outlet port 214 to prevent toner from flowing out of toner cartridge 200 and an open position permitting toner flow. For example, in the embodiment illustrated, a shutter 218 is positioned on bottom 204*b* of housing 203 and is slidably movable between a closed position and an open position. In the open position, shutter 218 permits toner to flow from outlet port 214 of toner cartridge 200. In the closed position, shutter 218 blocks outlet port 214 to prevent toner from escaping toner cartridge 200. In one embodiment, shutter 218 includes a foam seal attached to an inner surface thereof that seals against outlet port 214 when shutter 218 is in the closed position to collect any toner that escapes outlet port 214 when toner cartridge is removed from image forming device 100. Shutter 218 may be biased toward the closed position blocking outlet port 214. For example, one or more extension springs 222 may bias shutter 218 toward the closed position as shown. In the example embodiment illustrated, shutter 218 slides toward front end 208 when shutter 218 moves from the closed position to the open position and toward rear end 210 when shutter 218 moves from the open position to the closed position.

Toner cartridge 200 includes one or more electrical contacts 224 positioned on the outer surface of housing 203, e.g., on end wall 207. In one embodiment, electrical contacts 224 are positioned on a printed circuit board 226 that also includes processing circuitry 201. Processing circuitry 201 may provide authentication functions, safety and operational interlocks, operating parameters and usage information related to toner cartridge 200. Electrical contacts 224 are positioned to contact corresponding electrical contacts when toner cartridge 200 is installed in image forming device 100 in order to facilitate communications link 162 with controller 102.

FIG. 4 shows toner cartridge 200 with end cap 212 and a portion of wall 204 removed to more clearly illustrate the internal components of toner cartridge 200. A rotatable shaft 400 extends along the length of toner cartridge 200 within toner reservoir 202. As desired, the ends of rotatable shaft 400 may be received in bushings or bearings 228 positioned on an inner surface of end walls 206, 207. In operation, shaft 400 rotates in the direction shown by arrow A in FIGS. 4 and 5. Toner paddles 404 are mounted on and rotate with shaft 400 to stir and move toner within reservoir 202 as discussed in greater detail below. In one embodiment, shaft 400 is composed of metal, such as steel, to handle high torque loads resulting from the resistance to the rotation of paddles 404 provided by toner in reservoir 202. This resistance is particularly high when toner cartridge 200 is unused for an extended period of time, such as during shipping or storage, which may cause the toner in reservoir 202 to pack. In other embodiments, shaft 400 is composed of a rigid plastic material. In the example embodiment illustrated, toner cartridge 200 includes four paddles labeled 404*a*, 404*b*, 404*c* and 404*d*; however, more or fewer than four paddles 404 may be used as desired depending on, for example, the size of reservoir 202.

In one embodiment, each paddle 404 includes a pair of arms 406 that extend away from shaft 400 toward an interior surface 230 of housing 203 that forms reservoir 202. A crossbeam 410 is positioned between distal ends of each pair of arms 406 near interior surface 230. In the example embodiment illustrated, each crossbeam 410 includes a straight segment. A wiper 420 is mounted on an outer radial end of each crossbeam 410 across a flat surface 416 of the crossbeam 410. Wipers 420 are formed from a flexible material such as a polyethylene terephthalate (PET) material, e.g., MYLAR® available from DuPont Teijin Films, Chester, Va., USA. In one embodiment, wipers 420 form an interference fit with the interior surfaces 230 of top 204*a*, bottom 204*b* and sides 204*c*, 204*d* in order to wipe toner from the interior surfaces 230 as shaft 400 rotates. In the example embodiment illustrated, toner cartridge 200 include four wipers labeled 420*a*, 420*b*, 420*c* and 420*d* corresponding with the four paddles 404*a*, 404*b*, 404*c*, 404*d*.

In one embodiment, a gap 414 is formed between each crossbeam 410 and shaft 400 to allow toner in reservoir 202 to freely move near a central core 202*c* of reservoir 202 along a longitudinal axis 401 of shaft 400. This keeps toner fluffed, minimizes the torque on shaft 400, and reduces the surface area where toner can stick.

In some embodiments, paddles 404 are composed of a rigid plastic material. Paddles 404 may be formed individually or as a unitary assembly. For example, in the embodiment illustrated, paddles 404 are formed as a unitary plastic assembly overmolded on shaft 400.

Figure 5:
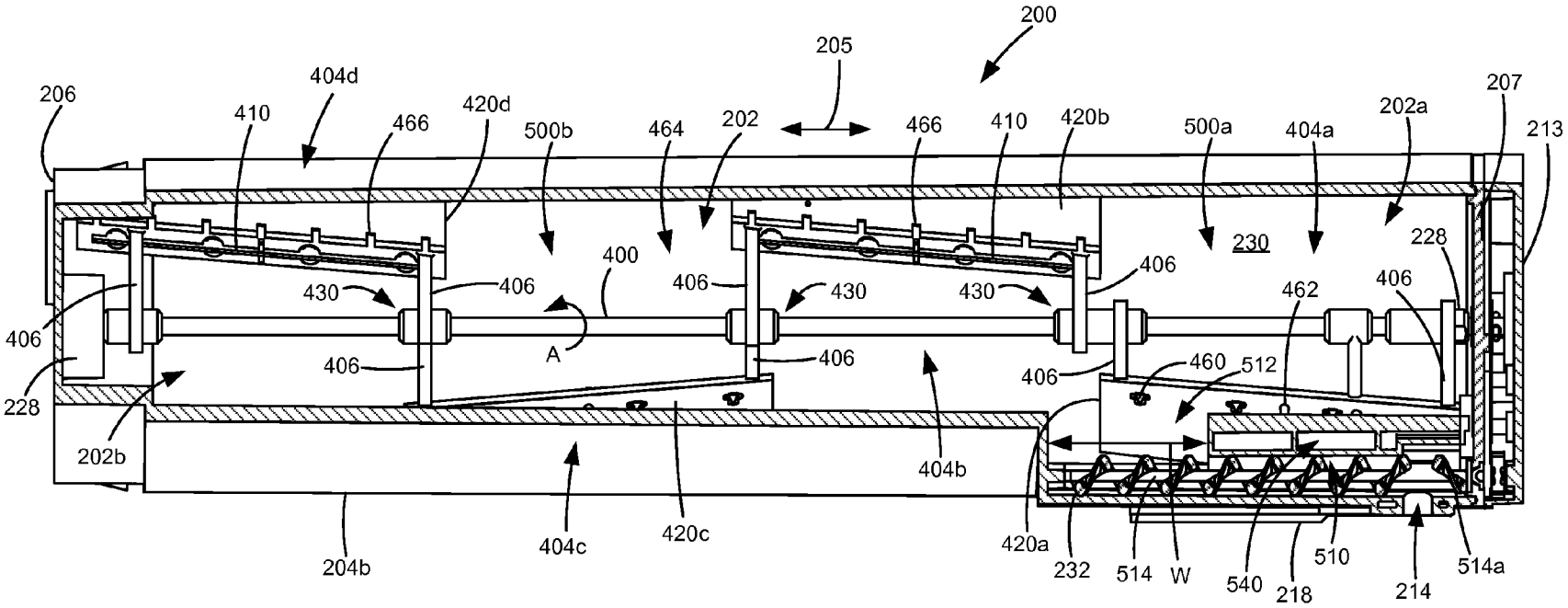
FIG. 5 is a side cross-sectional view of the toner cartridge of FIGS. 3 and 4 showing a toner metering zone according to one example embodiment.

FIG. 5 shows a side cross section of toner cartridge 200. In the example embodiment illustrated, housing 203 includes a channel 510 along at least a portion of bottom 204*b* of toner cartridge 200. Channel 510 includes an inlet 512 that is open at one end of channel 510 to reservoir 202 to receive toner from reservoir 202. Inlet 512 has a width W along lengthwise dimension 205 and is positioned between end walls 206 and 207. Channel 510 is open at its other end to outlet port 214 for exiting toner from channel 510. In the example embodiment illustrated, inlet 512 is positioned below an intersection or junction 430 of paddles 404*a* and 404*b* to allow both paddle 404*a* and paddle 404*b* to direct toner to inlet 512 of channel 510 as discussed in greater detail below. As desired, the width W and the position of inlet 512 along bottom 204*b* of housing 203 may be varied.

A rotatable auger 514 is positioned along channel 510 for moving toner received at inlet 512 to outlet port 214. Channel 510 includes a closed metering zone 540 positioned between inlet 512 and outlet port 214. Metering zone 540 regulates the amount of toner delivered by auger 514 to outlet port 214 in order to provide a more consistent flow rate of toner from toner cartridge 200 to imaging unit 300. In the example embodiment illustrated, four flutes of auger 514 are open to inlet 512 to receive toner from reservoir 202 in order to ensure that auger 514 is filled with toner in metering zone 540 as discussed in greater detail below.

With reference back to FIG. 3, a drive element 516 in the form of a gear or other form of drive coupler is exposed on an outer portion of housing 203 in position to receive rotational force from a corresponding drive element in image forming device 100 when toner cartridge 200 is installed in image forming device 100. In the example embodiment illustrated, drive element 516 is positioned on an outer surface of end wall 207; however, drive element 516 may be positioned elsewhere on housing 203 as desired. In one embodiment, drive element 516 is operatively connected (either directly or indirectly through one or more intermediate gears) to shaft 400 and auger 514 to rotate shaft 400 and auger 514 upon receiving rotational force from the corresponding drive element in image forming device 100. In another embodiment, drive element 516 is operatively connected to shaft 400 and a second drive element (not shown) is exposed on the outer portion of housing 203 to receive rotational force from a second drive element in image forming device 100 to rotate auger 514.

With reference to FIGS. 4 and 5, in one embodiment, adjacent paddles 404 alternate radially by 180 degrees along the length of shaft 400. This arrangement of paddles 404 keeps the torque on shaft 400 more uniform in comparison with paddles 404 all extending in the same radial direction. As the toner level in reservoir 202 decreases, where toner cartridge 200 includes an even number of paddles 404, half of the paddles 404 are out of the toner in reservoir 202 and half of the paddles 404 are in the toner at various points along the rotational path of shaft 400 thereby evening out the torque on shaft 400 through the rotational path of shaft 400. Further, if toner cartridge 200 is unused for an extended period of time, such as during shipping or storage, if half of the paddles 404 are out of the toner when rotation of shaft 400 resumes, the torque on shaft 400 is reduced in comparison with all of the paddles 404 being positioned in the toner thereby reducing the risk of breaking shaft 400 or paddles 404 due to excessive torque resulting from packed toner. Further, where paddles 404 are formed as a unitary molded plastic assembly, alternating adjacent paddles 404 radially by 180 degrees makes it easier to mold the paddle assembly.

In one embodiment, a paddle assembly 464 includes a first set 500*a* of one or more paddles 404 that are positioned between a first end 202*a* of reservoir 202 and inlet 512 and a second set 500*b* of one or more paddles 404 that are positioned between a second end 202*b* of reservoir 202 and inlet 512. First set 500*a* of paddles 404 are angled to direct toner away from first end 202*a* of reservoir 202 and toward inlet 512. Second set 500*b* of paddles 404 are angled to direct toner away from second end 202*b* of reservoir 202 and toward inlet 512. In the example embodiment illustrated, first set 500*a* of paddles 404 includes paddle 404*a* and second set 500*b* of paddles 404 includes paddles 404*b*, 404*c* and 404*d*; however, any number of paddles 404 may be included in each set 500*a*, 500*b* as desired. In another embodiment, all of the paddles 404 of toner cartridge 200 are angled to direct toner away from either first end 202*a* or second end 202*b* of reservoir 202 toward the opposite end 202*a* or 202*b* to inlet 512 or directly to outlet port 214 where toner cartridge 200 does not include a channel 510.

Figure 6:
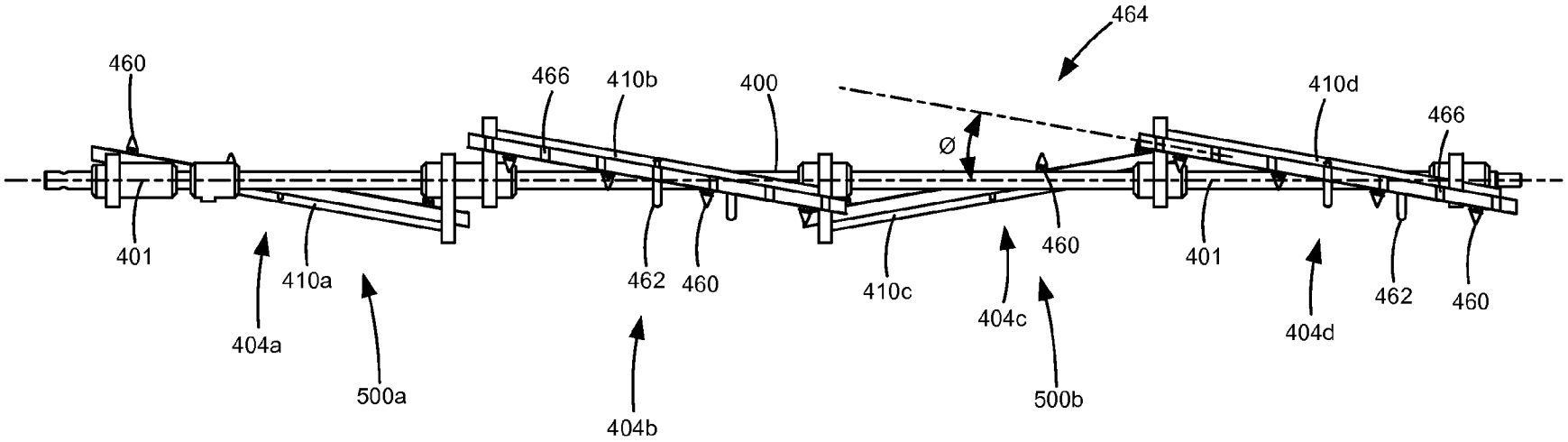
FIG. 6 is a top plan view of a paddle assembly of FIGS. 4 and 5 according to one example embodiment.

FIG. 6 is a top view of the paddle assembly 464 shown in FIGS. 4 and 5 mounted on shaft 400. In this embodiment, crossbeams 410 of paddles 404 are at an acute angle to longitudinal axis 401 of shaft 400. Specifically, in the embodiment illustrated, crossbeam 410*a* of paddle 404*a* forms an acute angle with longitudinal axis 401 of shaft 400 in a direction opposite an acute angle formed by crossbeams 410*b*, 410*c* and 410*d* of paddles 404*b*, 404*c* and 404*d* with respect to longitudinal axis 401 of shaft 400. In this manner, as shaft 400 rotates, the angle of crossbeams 410 causes paddles 404 to direct toner away from the ends of shaft 400 so that toner does not pack against the inner surface of wall 206 or wall 207 and toward inlet 512 to exit the toner from toner cartridge 200. As desired, paddles 404 may be angled relative to longitudinal axis 401 of shaft 400 by the same degree or different degrees. In one embodiment, each crossbeam 410*a*, 410*b*, 410*c*, 410*d* is angled between about 5 degrees and about 30 degrees relative to longitudinal axis 401 of shaft 400. For example, in one embodiment, an angle Ø of each crossbeam 410 relative to longitudinal axis 401 of shaft 400 is between about 8 degrees and about 12 degrees, such as about 10 degrees. In general, as angle Ø increases, more paddles 404 are needed in order to move and agitate the toner in reservoir 202 and vice versa. The width of reservoir 202 (orthogonal to longitudinal axis 401) defines how many paddles 404 are needed to agitate toner across the axial length of shaft 400. As the angle Ø of each paddle 404 increases, the axial distance covered by each paddle 404 along longitudinal axis 401 decreases thereby requiring more paddles 404 to agitate toner across the axial length of shaft 400. As the number of paddles 404 increases, the manufacturing cost of paddle assembly 464 tends to increase. If the angle Ø of each paddle 404 is too high, the toner level across reservoir 202 is significantly uneven. A significantly uneven toner level may cause toner to pack in areas of reservoir 202 with a relatively high toner level, may increase the torque on shaft 400, may affect the feed rate of toner from toner cartridge 200 and may cause toner leaking.

The angle of paddles 404 also allows wipers 420 to gradually move in and out of engagement with interior surface 230 at the corners of wall 204 beginning with one axial end of the wiper 420 and ending with the opposite axial end of the wiper 420, thereby reducing the noise associated with wipers 420 disengaging from interior surface 230. In contrast, where paddles 404 are not angled relative to longitudinal axis 401 of shaft 400, wipers 420 may tend to create an undesirable flicking noise as wipers 420 disengage from interior surface 230.

In one embodiment, the paddles 404 of each set 500*a*, 500*b* overlap axially with each other to prevent toner from adhering to the interior surface 230 of wall 204 at the intersection or junction 430 of each paddle 404 with the adjacent paddle 404. For example, in the embodiment illustrated in FIG. 6, adjacent axial ends of paddles 404*b* and 404*c* overlap with each other axially and adjacent axial ends of paddles 404*c* and 404*d* overlap with each other axially. In one embodiment, paddles 404 overlap with each other axially by at least about 10 mm.

With reference back to FIG. 5, in one embodiment, inlet 512 is positioned at the intersection 430 of first set 500*a* of paddles 404 with second set 500*b* of paddles 404. In this embodiment, adjacent axial ends of paddle 404*a* and paddle 404*b* are aligned axially with inlet 512 and the exposed auger flutes of auger 514. In this configuration, toner is fed by paddles 404*a* and 404*b* to inlet 512 twice per revolution of shaft 400 to ensure that auger 514 remains filled with toner to promote a consistent flow rate of toner from toner cartridge 200.

With reference to FIGS. 4-7, a distal end of each wiper 420 extends further radially outward than a distal end of the crossbeam 410 on which it is mounted. This allows wipers 420 to flex against flat surfaces 416 of crossbeams 410 as wipers 420 contact interior surface 230 during rotation of shaft 400. Flat surfaces 416 allow wipers 420 to flex about a single axis defined by the outer radial line of flat surface 416. If wipers 420 were instead permitted to flex about more than one axis, wipers 420 may tend to wrinkle thereby reducing the toner cleaning effectiveness of wipers 420. The flexing of wipers 420 increases the contact between wipers 420 and interior surface 230 thereby improving the ability of wipers 420 to clean toner from interior surface 230. The flexing of wipers 420 also reduces the torque on paddle assembly 464 and compensates for manufacturing tolerances between paddle assembly 464 and housing 203. In the example embodiment illustrated, each crossbeam 410 includes a series of axially spaced barbed mounts 460 and locating pins 462 that extend away from flat surface 416 for mounting wiper 420 on crossbeam 410. In this embodiment, barbed mounts 460 secure wiper 420 against flat surface 416 of crossbeam 410 and locating pins 462 align wiper 420 to prevent improper installation of wiper 420 onto crossbeam 410. Each barbed mount 460 includes a member 461 at its distal end that tapers to a point as it extends away from flat surface 416. During installation of wiper 420 onto barbed mounts 460, the tapered distal end of each barbed mount 460 is pressed through a corresponding slot 422 on wiper 420. Each barbed mount 460 includes a trunk portion 472 proximate to flat surface 416 that has a smaller cross section than at least a portion of barb member 461 so that wiper 420 is held on crossbeam 410 between barb members 461 and flat surface 416. As desired, the curvature C of distal end of each wiper 420 may be modified depending on the angle Ø of paddle 404 relative to longitudinal axis 401 of shaft 400 and the shape of interior surface 230.

With reference to FIGS. 4 and 5, in one embodiment, a series of anti-crease ribs 466 extend outward in the radial dimension from the distal end of each crossbeam 410. The distal ends of wipers 420 extend past distal ends of ribs 466. Ribs 466 are angled away from wipers 420 in order to permit wipers 420 to flex counter to the direction of rotation during rotation of shaft 400. Ribs 466 limit how far wipers 420 are able to flex in order to prevent wipers 420 from creasing or permanently bending.

As shown in FIG. 5, in one embodiment, a cross-sectional diameter (or height and width) of housing 203 is reduced at an end portion of housing 203 adjacent to end wall 206. As shown in FIG. 3, the reduced cross-section of housing 203 near end wall 206 accommodates a collar 212*a* of end cap 212 that extends over and mounts on the outer surface of wall 204 near end wall 206. The reduced cross-section of housing 203 near end wall 206 allows the outer surface of collar 212*a* to be flush with the rest of the outer surface of wall 204.

Figure 7:
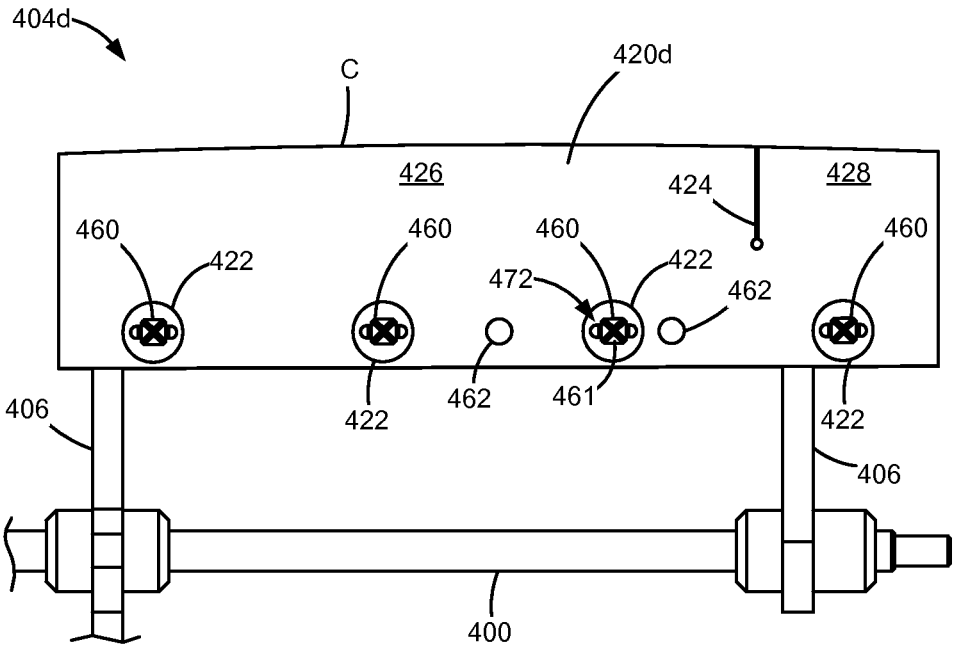
FIG. 7 is a side elevation view of a portion of the paddle assembly according to one example embodiment.

With reference to FIGS. 4 and 7, in one embodiment, wiper 420*d* of paddle 404*d* includes a cut or split 424 running radially inward from a distal end of wiper 420*d*. Split 424 is axially positioned at the point where the cross-section of housing 203 decreases near end wall 206. Split 424 permits an end portion 428 of wiper 420*d* positioned in the reduced cross-section of housing 203 to flex a different amount than a portion 426 of wiper 420*d* that is not positioned in the reduced cross-section of housing 203 near end wall 206. In one embodiment, each wiper 420 includes split 424 so that a common wiper 420 may be used for all paddles 404 to reduce manufacturing complexity.

With reference back to FIG. 5, in some embodiments, the efficiency of paddle assembly 464 delivering toner to channel 510 at inlet 512 and of metering zone 540 regulating the amount of toner delivered by auger 514 to outlet port 214 permits channel 510 and auger 514 to be less than the full length of toner cartridge 200. For example, in one embodiment, channel 510 and auger 514 are less than half the length of toner cartridge 200. Further, in the example embodiment illustrated, channel 510 and auger 514 are less than one-third of the length of toner cartridge 200. The decreased length of auger 514 allows the core diameter of auger 514 to be relatively small to achieve sufficient stiffness of auger 514 and sufficient flow of toner in metering zone 540 in comparison with the core diameter required for an auger than spans the entire length of toner cartridge 200. The reduced core diameter of auger 514, in turn, allows the overall diameter of auger 514 to be relatively small as well. The reduced diameter and reduced length of auger 514 also reduces the area of wall surface 232 under auger 514 where toner can be trapped thereby reducing the amount of residual toner in channel 510 and the torque on auger 514.

In the example embodiment illustrated, auger 514 includes a reverse pitch flute 514*a* at the end of auger 514 adjacent to outlet port 214. Reverse flute 514*a* moves toner away from the end of channel 510 at end wall 207 and toward outlet port 214 in order to prevent toner from being trapped at the end of auger 514 against end wall 207.

The gear ratio between shaft 400 and auger 514 may be selected to achieve a desired toner flow rate from reservoir 202. In general, the number of rotations of auger 514 per rotation of shaft 400 is less than the number of flutes of auger 514 that are open to inlet 512 multiplied by the number of times toner is delivered to inlet 512 per rotation of shaft 400. As discussed above, in the example embodiment illustrated, four flutes of auger 514 are open to inlet 512 to receive toner from reservoir 202, and toner is delivered to inlet 512 twice per revolution of shaft 400 (once by paddle 404*a* and once by paddle 404*b*). Accordingly, in this embodiment, the gear ratio between shaft 400 and auger 514 is less than 8:1 (i.e., for every rotation of shaft 400, auger 514 rotates less than eight times). For example, in one embodiment, the gear ratio between shaft 400 and auger 514 is between about 3:1 and about 4:1, such as about 3.3:1, in order to ensure that auger 514 is filled with toner as it enters metering zone 540.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for an electrophotographic image forming device, comprising:

a housing having a reservoir for storing toner and an outlet for exiting toner from the housing, the reservoir has a first end and an opposed second end along a length of the housing;

a channel in the housing along at least a portion of the length of the housing, the channel has an inlet positioned between the first end and the second end of the reservoir, the inlet is in fluid communication with the reservoir for receiving toner from the reservoir and the channel is in fluid communication with the outlet for exiting toner from the channel;

a rotatable auger positioned along the channel for moving toner in the channel toward the outlet;

a rotatable shaft having a first end at the first end of the reservoir and a second end at the second end of the reservoir; and a plurality of paddles extending from the shaft and rotatable with the shaft, the plurality of paddles includes a first set of one or more paddles positioned between the first end of the reservoir and the inlet of the channel and a second set of one or more paddles positioned between the second end of the reservoir and the inlet of the channel, the first set of one or more paddles are angled to direct toner away from the first end of the reservoir and toward the inlet of the channel and the second set of one or more paddles are angled to direct toner away from the second end of the reservoir and toward the inlet of the channel, wherein each of the plurality of paddles includes a rigid and substantially straight segment that extends along a length of the shaft and a flexible member on a distal end of the substantially straight segment that extends radially outward past the distal end of the substantially straight segment, a first axial end of the substantially straight segment is angularly offset from a second axial end of the substantially straight segment relative to a longitudinal axis of the shaft such that the substantially straight segment is angled relative to the longitudinal axis of the shaft, wherein each of the plurality of paddles includes a plurality of ribs extending outward from the distal end of the substantially straight segment, the ribs are angled away from the flexible member trailing the flexible member in an operative rotational direction of the shaft and positioned to limit by contacting the flexible member how far the flexible member flexes counter to the operative rotational direction of the shaft.

2. The replaceable unit of claim 1, wherein adjacent axial ends of the one or more paddles of at least one of the first set and the second set overlap axially with each other.

3. The replaceable unit of claim 1, wherein each of the one or more paddles of the first set forms an angle of between about 5 degrees and about 30 degrees in a first direction relative to a longitudinal axis of the shaft and each of the one or more paddles of the second set forms an angle of between about 5 degrees and about 30 degrees in a second direction opposite the first direction relative to the longitudinal axis of the shaft.

4. The replaceable unit of claim 1, wherein adjacent paddles of the plurality of paddles alternate radially along a length of the shaft.

5. The replaceable unit of claim 1, wherein at least one of a cross-sectional height and width of the reservoir is reduced at the first end of the reservoir relative to an adjacent portion of the reservoir.

6. A replaceable unit for an electrophotographic image forming device, comprising:

a housing having a reservoir for storing toner and an outlet for exiting toner from the housing, the reservoir has a first end and an opposed second end along a length of the housing;

a channel in the housing along at least a portion of the length of the housing, the channel has an inlet positioned between the first end and the second end of the reservoir, the inlet is in fluid communication with the reservoir for receiving toner from the reservoir and the channel is in fluid communication with the outlet for exiting toner from the channel;

a rotatable auger is positioned along the channel for moving toner in the channel toward the outlet;

a rotatable shaft has a first end at the first end of the reservoir and a second end at the second end of the reservoir, a first portion of the shaft is positioned between the first end of the reservoir and the inlet of the channel and a second portion of the shaft is positioned between the second end of the reservoir and the inlet of the channel;

a plurality of paddles rotatable with the shaft, each of the plurality of paddles is connected to the shaft by a corresponding pair of arms extending radially from the shaft, adjacent paddles of the plurality of paddles alternate radially along a length of the shaft, the plurality of paddles includes a first set of one or more paddles on the first portion of the shaft and a second set of one or more paddles on the second portion of the shaft, the first set of one or more paddles are angled to direct toner away from the first end of the reservoir and toward the inlet of the channel and the second set of one or more paddles are angled to direct toner away from the second end of the reservoir and toward the inlet of the channel; and a flexible member on a distal end of each of the plurality of paddles, at least a portion of each flexible member has an interference contact with at least a portion of an interior surface of the housing, wherein each of the plurality of paddles includes a rigid and substantially straight segment that extends along the length of the shaft and the flexible member is positioned on a distal end of the substantially straight segment and extends radially outward past the distal end of the substantially straight segment, a first axial end of the substantially straight segment is angularly offset from a second axial end of the substantially straight segment relative to a longitudinal axis of the shaft such that the substantially straight segment is angled relative to the longitudinal axis of the shaft, wherein each of the plurality of paddles includes a plurality of ribs extending outward from the distal end of the substantially straight segment, the ribs are angled away from the flexible member trailing the flexible member in an operative rotational direction of the shaft and positioned to limit by contacting the flexible member how far the flexible member flexes counter to the operative rotational direction of the shaft.

7. The replaceable unit of claim 6, wherein adjacent axial ends of the one or more paddles of at least one of the first set and the second set overlap axially with each other.

8. The replaceable unit of claim 6, wherein each of the one or more paddles of the first set forms an angle of between about 5 degrees and about 30 degrees in a first direction relative to a longitudinal axis of the shaft and each of the one or more paddles of the second set forms an angle of between about 5 degrees and about 30 degrees in a second direction opposite the first direction relative to the longitudinal axis of the shaft.

9. The replaceable unit of claim 6, wherein at least one of a cross-sectional height and width of the reservoir is reduced at the first end of the reservoir relative to an adjacent portion of the reservoir.

10. A replaceable unit for an electrophotographic image forming device, comprising:

a housing having a reservoir for storing toner and an outlet for exiting toner from the housing, the reservoir has a first end and an opposed second end;

a rotatable shaft having a first end at the first end of the reservoir and a second end at the second end of the reservoir; and a plurality of paddles extending from the shaft along a length of the shaft and rotatable with the shaft, each of the plurality of paddles includes a rigid and substantially straight segment that extends along the length of the shaft, each of the plurality of paddles includes a flexible member on a distal end of the substantially straight segment that extends radially outward past the distal end of the substantially straight segment, at least a portion of each flexible member has an interference contact with at least a portion of an interior surface of the housing, each of the plurality of substantially straight segments is angled relative to the shaft to direct toner away from the first end of the reservoir and toward the second end of the reservoir, wherein each of the plurality of paddles includes a plurality of ribs extending outward from the distal end of the substantially straight segment, the ribs are angled away from the flexible member trailing the flexible member in an operative rotational direction of the shaft and positioned to limit by contacting the flexible member how far the flexible member flexes counter to the operative rotational direction of the shaft.

11. The replaceable unit of claim 10, wherein adjacent axial ends of the plurality of paddles overlap axially with each other.

12. The replaceable unit of claim 10, wherein each of the plurality of substantially straight segments forms an angle of between about 5 degrees and about 30 degrees relative to a longitudinal axis of the shaft.

13. The replaceable unit of claim 10, wherein adjacent paddles of the plurality of paddles alternate radially along a length of the shaft.

14. The replaceable unit of claim 10, wherein at least one of a cross-sectional height and width of the reservoir is reduced at at least one of the first end and the second end of the reservoir relative to an adjacent portion of the reservoir.

15. The replaceable unit of claim 10, wherein each of the rigid and substantially straight segments is connected to the shaft by a corresponding pair of arms extending radially from the shaft.

16. A replaceable unit for an electrophotographic image forming device, comprising:

a housing having a reservoir for storing toner and an outlet for exiting toner from the housing, the reservoir has a first end and an opposed second end;

a rotatable shaft having a first end at the first end of the reservoir and a second end at the second end of the reservoir; and a paddle extending from the shaft and rotatable with the shaft, the paddle includes a rigid and substantially straight segment that extends along the length of the shaft, the paddle includes a flexible member on a distal end of the substantially straight segment that extends radially outward past the distal end of the substantially straight segment, at least a portion of the flexible member has an interference contact with at least a portion of an interior surface of the housing, wherein the paddle includes a plurality of ribs extending outward from the distal end of the substantially straight segment, the ribs are angled away from the flexible member trailing the flexible member in an operative rotational direction of the shaft and positioned to limit by contacting the flexible member how far the flexible member flexes counter to the operative rotational direction of the shaft.

* * * * *